United States Patent [19]

Maloblocki

[11] 4,353,174

[45] Oct. 12, 1982

[54] ELECTRONIC CONTROL SYSTEM FOR PNEUMATIC-HYDRAULIC PUMP DREDGE

[75] Inventor: Richard Maloblocki, Hinsdale, Ill.

[73] Assignee: Amtec Development Company, Highland Park, Ill.

[21] Appl. No.: 176,924

[22] Filed: Aug. 11, 1980

[51] Int. Cl.[3] ..... E02F 3/88

[52] U.S. Cl. ..... 37/58; 417/125

[58] Field of Search ..... 37/59, 58, 195, 54; 417/125, 120, 121, 122, 123

[56] References Cited

U.S. PATENT DOCUMENTS

| | | | |
|---|---|---|---|
| 209,159 | 10/1878 | Cummings | 37/59 |
| 407,044 | 7/1889 | Von Schmidt | 37/65 |
| 503,732 | 8/1893 | Bates | 37/58 |
| 545,762 | 9/1895 | Bates | 37/65 |
| 626,491 | 6/1899 | Ford | 37/72 X |
| 634,864 | 10/1899 | Bates | 37/65 |
| 645,660 | 3/1900 | Bell | 37/59 |
| 654,764 | 7/1900 | Schauffleberger | 417/125 |
| 662,210 | 11/1900 | Wheeler | 37/59 |
| 672,247 | 4/1901 | Wheeler et al. | 37/59 |
| 716,173 | 12/1902 | Bates | 37/65 |
| 934,031 | 9/1909 | Askew | 37/58 |
| 955,301 | 4/1910 | Wray | 417/125 |
| 1,000,713 | 8/1911 | Callow | 37/59 X |
| 1,144,406 | 6/1915 | Bartholomew | 37/61 |
| 1,205,114 | 11/1916 | Shaw | 417/122 |
| 1,326,321 | 12/1919 | Callahan | 37/59 X |
| 1,667,219 | 4/1928 | Ream | 37/65 |
| 1,862,260 | 6/1932 | Edmunds | 175/100 |
| 2,370,430 | 2/1945 | Waldeck | 37/67 |
| 2,669,941 | 2/1954 | Stafford | 417/125 |
| 2,857,852 | 10/1958 | Carignoni et al. | 416/122 |
| 3,005,417 | 10/1961 | Swaney | 417/138 X |
| 3,155,049 | 11/1964 | Mandelbaum et al. | 417/125 |
| 3,319,654 | 5/1967 | Faldi | 137/624.13 |
| 3,495,409 | 2/1970 | Riedemann | 37/58 X |
| 3,552,884 | 1/1971 | Faldi | 417/122 |
| 3,590,501 | 7/1971 | Bodine | 37/58 X |
| 3,624,933 | 12/1971 | Faldi | 37/71 X |
| 3,667,865 | 6/1972 | Faldi | 417/122 |
| 3,693,272 | 9/1972 | Bates | 37/65 |
| 3,791,763 | 2/1974 | Faldi | 37/58 X |
| 3,803,856 | 4/1974 | Faldi | 37/63X |
| 3,842,521 | 10/1974 | Faldi | 37/59 X |
| 3,842,522 | 10/1974 | Holzenburger et al. | 37/59 X |
| 3,871,581 | 3/1975 | Direly | 239/16 |
| 3,881,530 | 5/1975 | Faldi | 141/384 |
| 3,883,269 | 5/1975 | Wolff | 417/122 |
| 3,958,346 | 5/1976 | Faldi | 37/59 |
| 3,994,082 | 11/1976 | Faldi | 37/71 |
| 4,004,357 | 1/1977 | Faldi | 37/71 X |
| 4,140,437 | 2/1979 | Faldi | 417/122 |
| 4,170,079 | 10/1979 | Holekamp | 37/72 X |
| 4,253,255 | 3/1981 | Durell | 37/59 X |

OTHER PUBLICATIONS

Joanknecht, L. W. F.; "Results of Tests on Two Cutter Heads, Operating in Sand"; *First International Symposium on Dredging Technology;* pp. F1-1 to F1-20; 9/75.

Lumbard, D.; "A New Patented Dredging System Operated by Compressed Air"; *Hydrotransport 2 The Second International Conference in the Hydraulic Transport of Solids in Pipes;* 9/72; pp. K5-53 to K5-60.

Marv, T.; "Oozer Pump", [Oozer (Hedoro) Pump Dredging Barge], Toyo Construction Co.; 1974; Japanese and Translation.

Nishi, K.; "Dredging of High Density Sludge Using Oozer Pump"; *Dredging: Environmental Effects & Technology,* Proceedings of WODCON VII, 7/76.

*Primary Examiner*—Clifford D. Crowder

*Attorney, Agent, or Firm*—Trexler, Bushnell & Wolters, Ltd.

[57] ABSTRACT

A control system is disclosed for a dredging device which includes a submersible pump having one or more chambers. Each chamber defines an air port through which air can be delivered to and exhausted from the chamber, a material discharge port for discharging liquid and solid material from the chamber, and a chamber suction port for admitting liquid and solid material to the chamber. Air control valves are provided for alternately exhausting air from each chamber to admit material to the chamber through the suction port and for delivering air to each chamber so as to discharge material from the chamber through the discharge port. The control system operates these air control valves in accordance with a selectable timed cycle to achieve optimum efficiency in the dredging operation.

10 Claims, 9 Drawing Figures

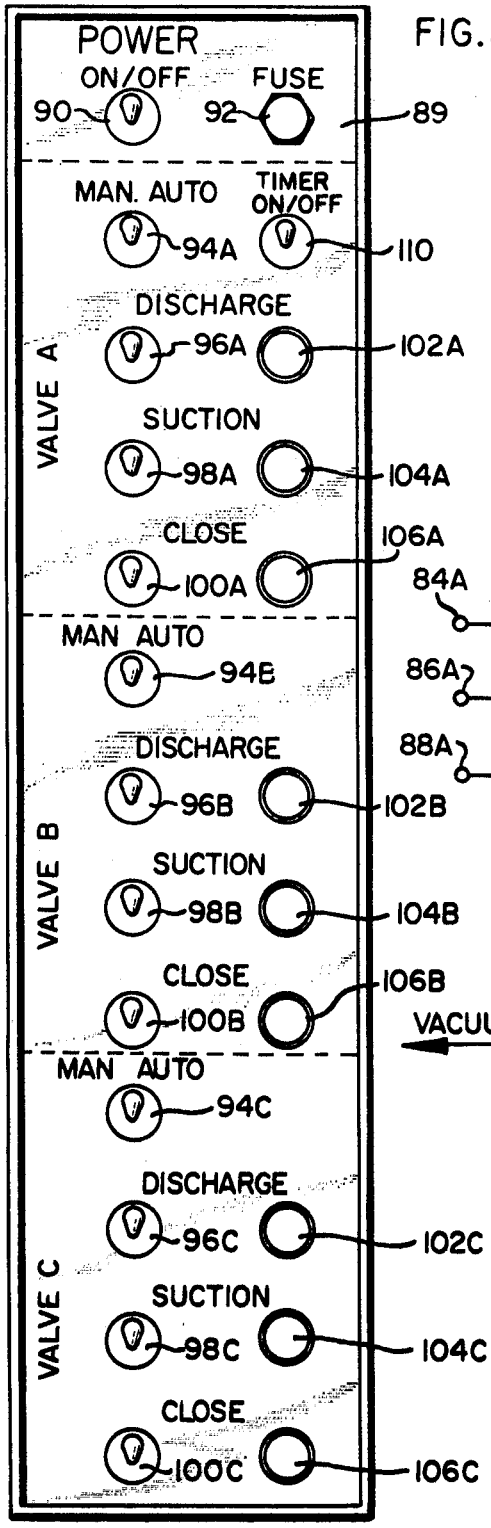
FIG.5
FIG.4
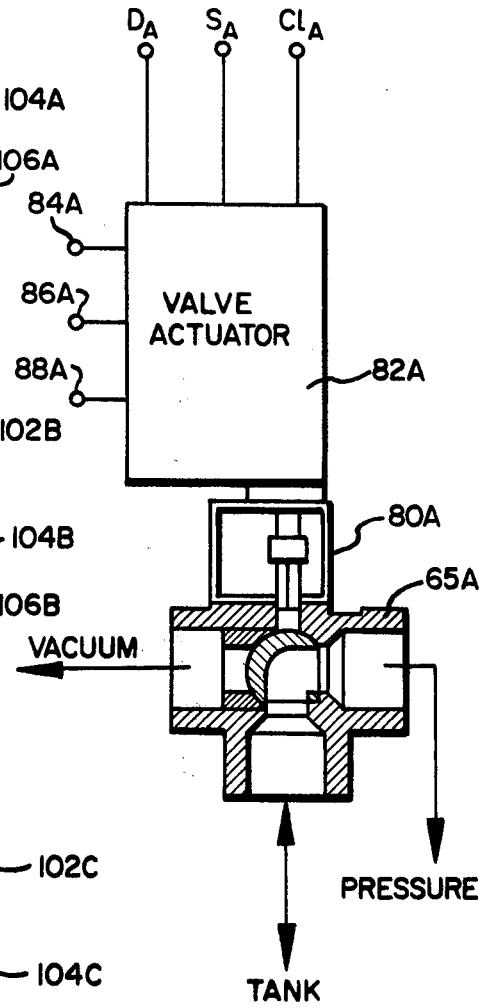

ELECTRONIC CONTROL SYSTEM FOR PNEUMATIC-HYDRAULIC PUMP DREDGE

BACKGROUND OF THE INVENTION

Dredges have been used for many years to remove submerged material from the bottom of lakes, harbors and other water areas. Reasons for engaging in dredging include deepening waterways to facilitate marine navigation, removal of bottom pollutants, recovery of bottom materials which have commercial value, and others.

Many common dredging devices are large, very expensive, and of limited use. For example, many hydraulic and pneumatic dredges will operate efficiently only in deep water, or only when excavating and removing a particular type of bottom material. Clam-shell dredges, crane buckets and other mechanical dredging devices operate efficiently only when excavating other types of bottom material, and can be expensive to operate. Most dredges require extensive ancillary systems to support the dredge, or to carry away the dredged material, or both.

In the past several years, a submergible pneumatic-hydraulic dredge pump has been offered to overcome some of these problems. However, in some forms it has met with only limited success. Operators have discovered that some forms of this pump work only in relatively deep water, and with loose material which need not be aggressively cut or separated from surrounding bottom material. In other conditions, operation of the pump has tended to become inefficient, yet efficient pump operation over a broad variety of conditions has heretofore proven expensive and difficult to control. If pump operations cannot be carefully monitored and controlled, the dredging operation can be so inefficient as to cause the pump operator serious financial difficulty.

My co-pending application, Ser. No. 067,156, filed Aug. 16, 1979, discloses a novel pneumatic-hydraulic pump dredge which can operate efficiently in deep or shallow water, and which can efficiently, precisely excavate a wide variety of materials.

It is a general object of this invention to provide an electronic control system for a pneumatic-hydraulic pump dredge and associated system generally of the type disclosed in my aforesaid copending application.

A related object is to provide such a control system which optimizes the efficiency of operation of the pneumatic-hydraulic pump dredge and associated system.

A more specific object is to provide such a control system which is capable of controlling pump dredge operation in accordance with a predetermined time cycle of operation of the pump dredge.

A related object is to provide a control system in accordance with the foregoing object wherein the time cycle of operation is further selectively controllable in accordance with the dredging conditions encountered.

Yet another object is to offer an electronic control system for a pneumatic-hydraulic pump dredge which can be constructed and operated at relatively low cost, yet which is reliable in service and rugged in design.

BRIEF DESCRIPTION OF THE DRAWINGS

Other objects, features and advantages of the invention will become apparent upon reading the following detailed description of the illustrated embodiment and upon reference to the accompanying drawings, wherein:

FIG. 4 is a plan view, partially in section, of a valve and of a valve actuator in block form;

FIG. 5 is a plan view showing a control panel of the electronic control system of the invention;

DETAILED DESCRIPTION OF THE ILLUSTRATED EMBODIMENT

While the invention will be described in connection with a preferred embodiment, it will be understood that it is not intended to limit the invention to this embodiment. On the contrary, it is intended to cover all alternatives, modifications and equivalents as may be included within the spirit and scope of the invention as defined by the appended claims.

Figure 1:
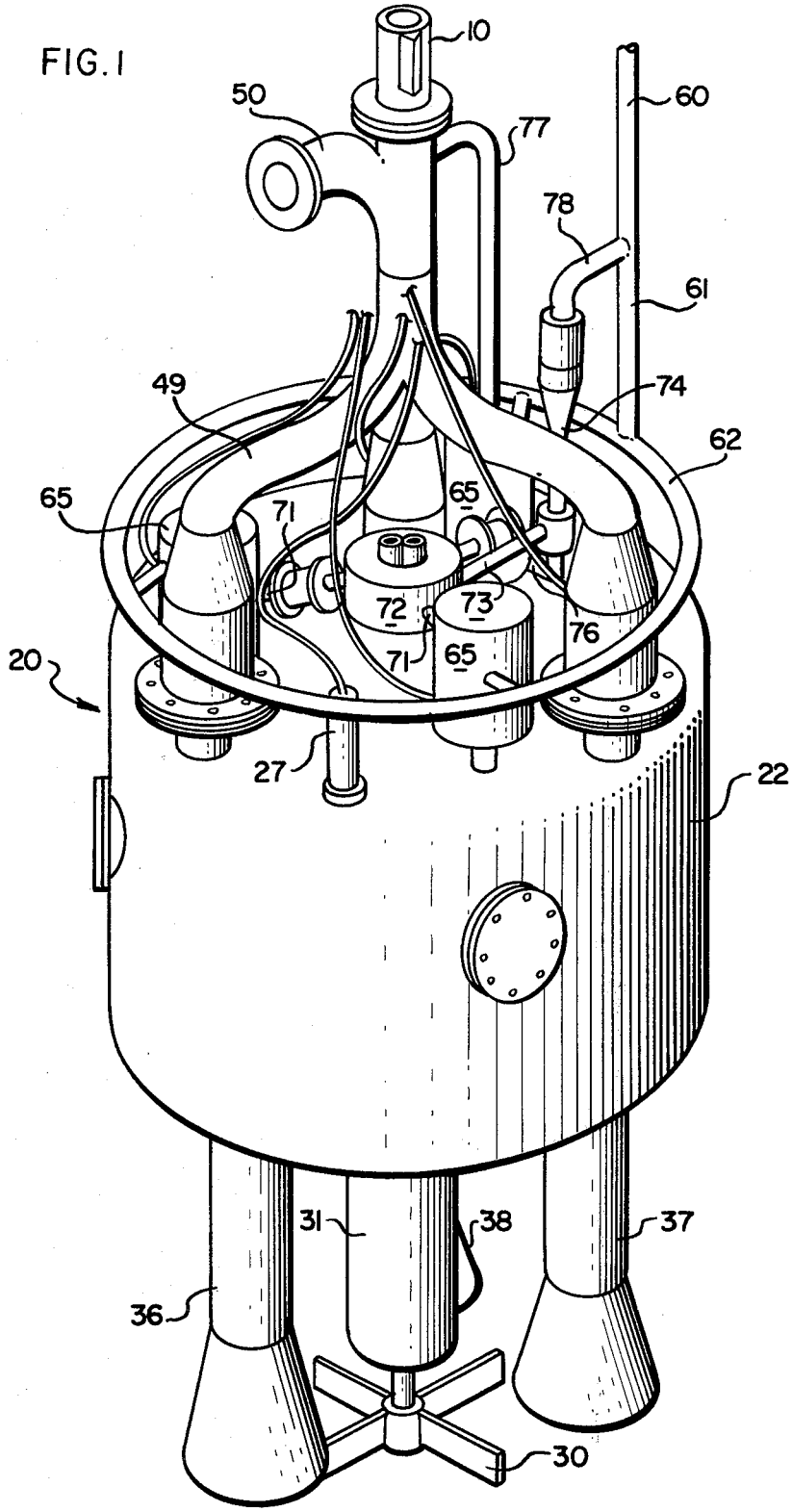
FIG. 1 is a perspective view showing a dredge pump with which an electronic control system according to the invention may advantageously be utilized.
Figures 2, 3:
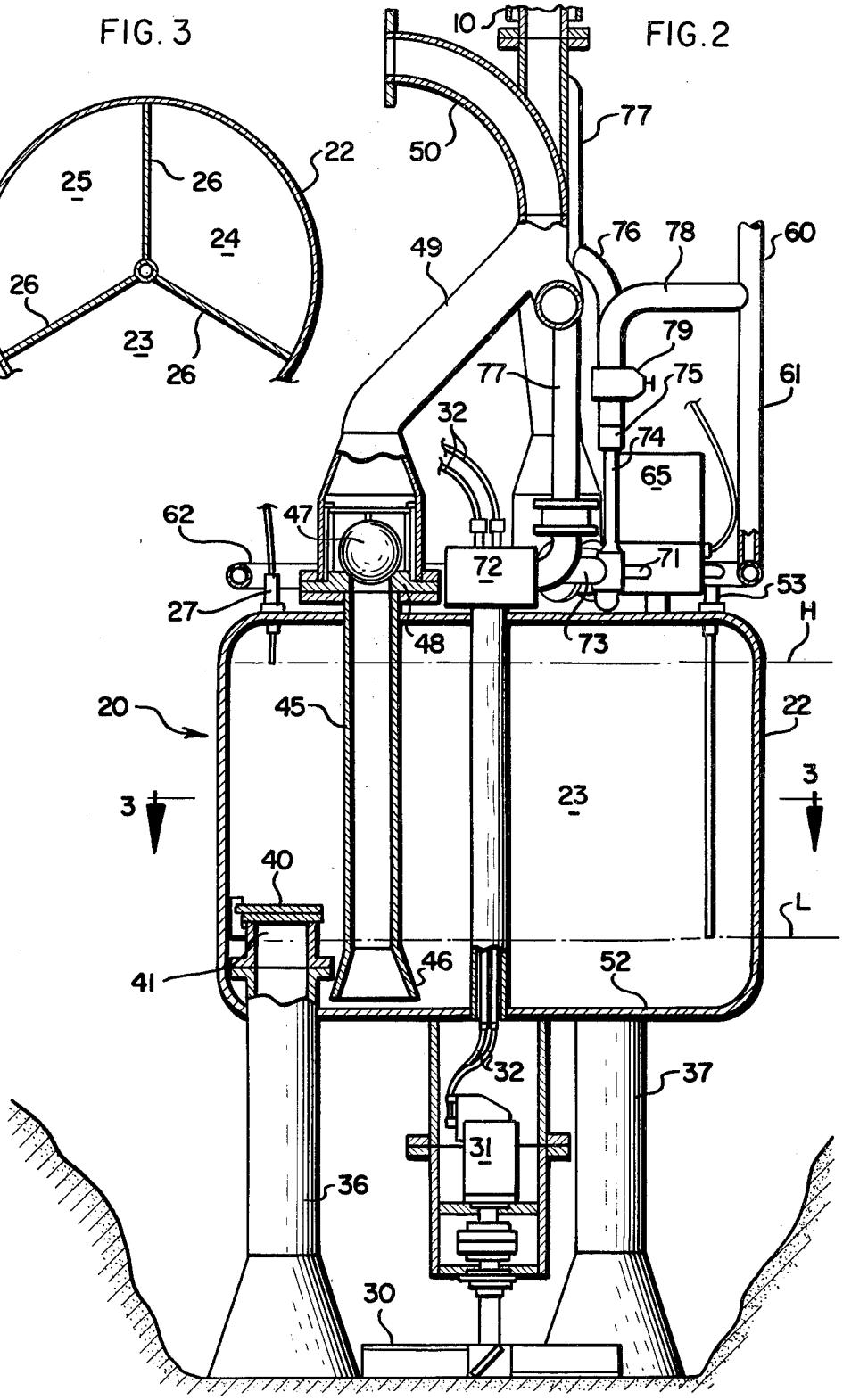
FIG. 2 is an elevational view in partial section showing the interior of the dredge pump of FIG. 1 and associated apparatus.
FIG. 3 is a simplified reduced sectional view taken generally in the plane 3—3 of FIG. 2.

Turning more specifically to FIGS. 1 and 2, there is shown an embodiment of a dredge pump 20 as it might appear when used with a crane (not shown) for dredging operations. In general, the crane includes a power and control cab (not shown) from which is mounted a boom (not shown) in the usual manner. Suspended from the boom is a kelly bar 10, and suspended from the kelly bar 10 is the dredge pump 20. By appropriate manipulation of controls for the boom and other crane parts, the dredge operator can precisely locate the dredge pump 20 at a given location for dredging operations.

Below the pump 20 is a material cutter 30. To rotate the cutter 30, a hydraulic or other suitable motor 31 is here mounted between the cutter 30 and dredge pump vessel 20, and is energized by appropriate hydraulic or other power lines 32. Cut material is drawn (or in some instances is forced by action of the cutter 30) up large diameter pipes 36, 37 and 38 to the pump 20.

Referring also to FIG. 3, the pump 20 will be seen to comprise a single vessel 22 which is internally divided into three pressure-tight chambers 23, 24 and 25 by internal chamber wall plates 26 which are secured in place by weldments or other convenient means. The interior arrangement of each chamber 23, 24 and 25 is identical with the interior arrangement of the other chambers, and pump operations within each of these chambers are identical, although staggered in time, as described below. Consequently, the interior operation of but a single chamber 23 need be described here.

Cut material flow to the chamber 23 is encouraged by developing a vacuum or "suction" in the chamber. To accomplish this, air is drawn from the chamber through a vacuum port of a valve, as more fully described below. Material entering the chamber 23 through the pipe 36 is prohibited from escaping backwardly from that chamber 23 through the pipe 36. To this end, a suction port check valve 40 is provided to selectively engage a suction port-defining extension pipe 41. The incoming material is, as illustrated, admitted into the chamber 23 at a relatively elevated position.

Dredge material continues to be urged into the chamber 23 through the pipe extension 41 for a preselected time, or until the chamber is filled to a high level H, and the dredge material reaches a high level sensor 27. When the preselected time expires or when the sensor 27 is actuated, the vacuum port of the valve is closed, the valve 40 closes and a compressed air port of the valve may then be opened to pressurize the chamber 23 to a positive pressure. As the compressed air enters the chamber, the dredge material or slurry previously sucked into the chamber 23 is forced out of the chamber through a discharge pipe 45 having a port or entrance 46. Material traveling up this discharge pipe 45 opens a one-way check valve, here by unseating a ball 47 from a ball valve seat 48. The material then travels around the ball 47 and up a discharge wye line 49 to a discharge collector pipe or hose 50. This hose can be routed away from the vessel 20, and to a convenient discharge point. It will be noted that the material discharge port or entrance 46 is located near the bottom 52 of the chamber 23 so as to encourage relatively complete liquid and solid material discharge from the chamber 23. Slurry discharge action continues for a preselected time, or until the material level in the chamber sinks to a predetermined low level L which is sensed by a low level sensor 53. When the preselected time expires or the low level sensor 53 is actuated, compressed air introduction is halted, and the vacuum may be re-created within the chamber 23. This action also causes the ball 47 to re-engage its seat 48, so as to inhibit return of dredged material to the chamber 23 through the discharge pipe 45 and port 46.

In accordance with one aspect of the invention, proper control of the compressed air introduction and vacuum exhaust system permits the dredge to be operated efficiently in very shallow water. For example, successful operations can be conducted in a very few feet or even inches of water so that the pump vessel itself need not be entirely submerged.

To introduce compressed air into the chambers 23, 24 and 25, air is compressed by a compressor of known design (not shown) and is delivered to the pump 20 through a single compressed air line 60. This air is directed through a pressure line 61 to a compressed air header 62 as shown in FIGS. 1 and 2. From this endless header 62, air is directed to three, three-way valves 65 for admission to the respective chambers 23, 24 and 25.

To exhaust air from the chamber, a vacuum of less than one atmosphere pressure is created, generated and maintained by the same compressed air system. To accomplish this, air and other gases from the chambers 23, 24 and 25 are drawn through the three, three-way valves 65 and through connector pipes 71 to a vacuum header 72. A collector vacuum line 73 leads from the header 72 to an air jet pump 74. A vacuum-creating stream of air is directed through a supply end 75 of this jet pump 74, and the vacuum-creating supply air and the gasses from the vacuum line 73 together travel along a jet pump exhaust line 76. This vacuum exhaust line 76 joins a similar vacuum exhaust line 77 from the vacuum header 72 which leads to the interior of the hollow kelly bar 10 for venting in an upward direction.

To minimize piping expense, the air supply for the jet pump 74 is provided by the compressed air inlet line 60 and a tee member 78 which connect the inlet air line 60 with the jet pump 74. The amount of vacuum provided is regulated by a valve 79 located between the tee member 78 and the air jet pump 74 itself.

Referring now to FIG. 4, the control valve 65 is illustrated in detail. One such valve 65 designated respectively as valve A, valve B and valve C, is provided for each of the three chambers 23, 24 and 25. In this regard, a conventional three-way valve is utilized and includes a suitable actuator member such as a motor 80, driven from a conventional actuator circuit 82, here illustrated in block form. Briefly, the actuator circuit 82 includes three control leads, here labeled D, S and C1, energization of each of which causes rotation of the motor 80 so as to place the three-way valve 65 into a corresponding one of its three possible positions. More specifically, this valve 65 has a common outlet coupled with the tank or chamber 23 and a rotatable valve element capable of rotation to one of three positions for coupling this chamber outlet to the pressurized air header 62, to the vacuum header 72, or to neither, effectively holding the chamber 23 closed.

In operation, energization of the D terminal of the valve actuator 82 causes "discharge" of the chamber 23. That is to say, the motor 80 responds to the actuator circuit 82 by rotating the valve element of the valve 65 so as to couple the pressure header 62 with the chamber 23 to encourage discharge of the material therefrom. Similarly, energization of the S terminal of the actuator circuit 82 causes the motor 80 to rotate the valve element so as to couple the vacuum header 72 with the tank or chamber 23, thereby creating suction for filling the chamber 23 with material. Finally, energization of the C1 terminal of the actuator circuit 82 causes rotation of the motor 80 to a position in which the valve element connects neither the pressure header 62 nor the vacuum header 72 with the tank or chamber 23 thus effectively holding the tank or chamber 23 closed.

Further in this regard, the actuator circuit 82 is provided with conventional limit sensors or switches, to be described below which sense when the motor 80 and hence the valve 65 has achieved each of these three positions and de-energize the respective control terminal and thereby de-energize the motor 80. As will be more fully discussed below, the actuator circuit 82 also has three output terminals 84, 86 and 88, fed from the respective limit sensors for purposes of energizing an external indicator, for example a lamp, to indicate when the valve has achieved each of its respective three positions.

Turning now to FIG. 5, a control panel 89 for the control system of the invention is illustrated. This control panel includes a master power on/off switch 90 together with a suitable fuse 92 for controlling the delivery of electrical power to the system of the invention. This control panel 89 also includes three control sections labeled respectively "valve A", "valve B", and "valve C", for controlling the operation of the valves 65 associated with each of the chambers 23, 24 and 25. Since each of these control sections is the same only the control section associated with valve A, that is, the valve 65 associated with the chamber 23, will be described.

This "valve A" control section includes a manual automatic (MAN-AUTO) control switch 94 and control switches 96 for discharge, 98 for suction and 100 for close. As mentioned above, the valve positions for discharge, suction and close have respective indicator lamps 102, 104, 106 associated therewith. These same reference numerals will be used hereinafter together with the suffixes A, B and C to refer respectively to the corresponding control switches and indicator lamps associated with the valve 65 for the chambers 23, 24 and 25. Additionally, a timer on/off switch 110 is provided and as will be seen later controls actuation of a timer associated with the control system of the invention.

Generally, each manual automatic switch 94 serves to select either automatic, timed operation of the associated control valves 65 or alternatively, manual control of these valves by way of the respective switches 96, 98 and 100. In either case, the indicator lamps 102, 104 and 106 respectively light in response to the control lines 84, 86 and 88 of FIG. 4 to indicate the current position of the valve 65.

Figure 6A:
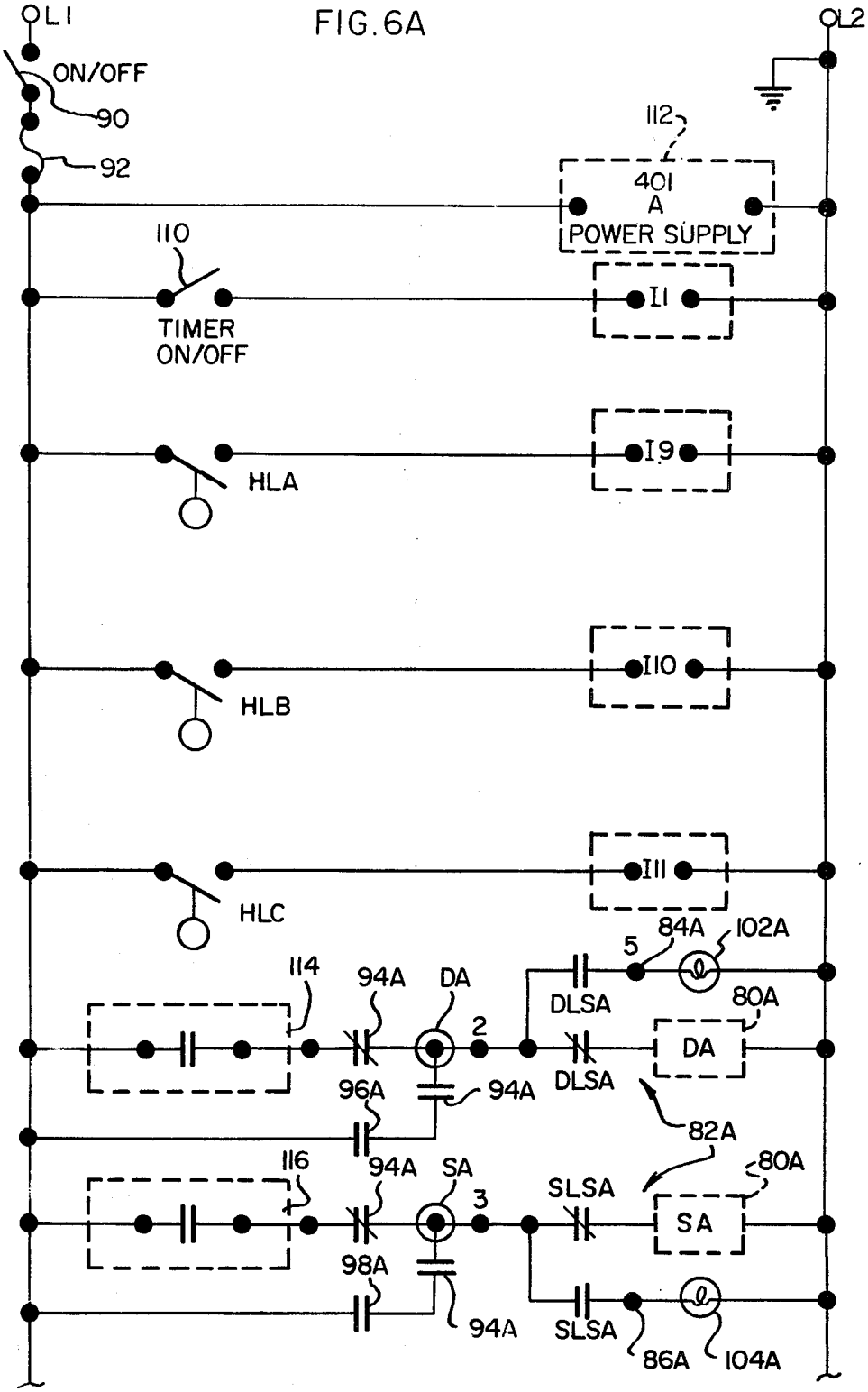
FIGS. 6A and 6B together form a circuit schematic diagram, partially in block form, of a portion of the electronic control system of the invention.
Figure 6B:
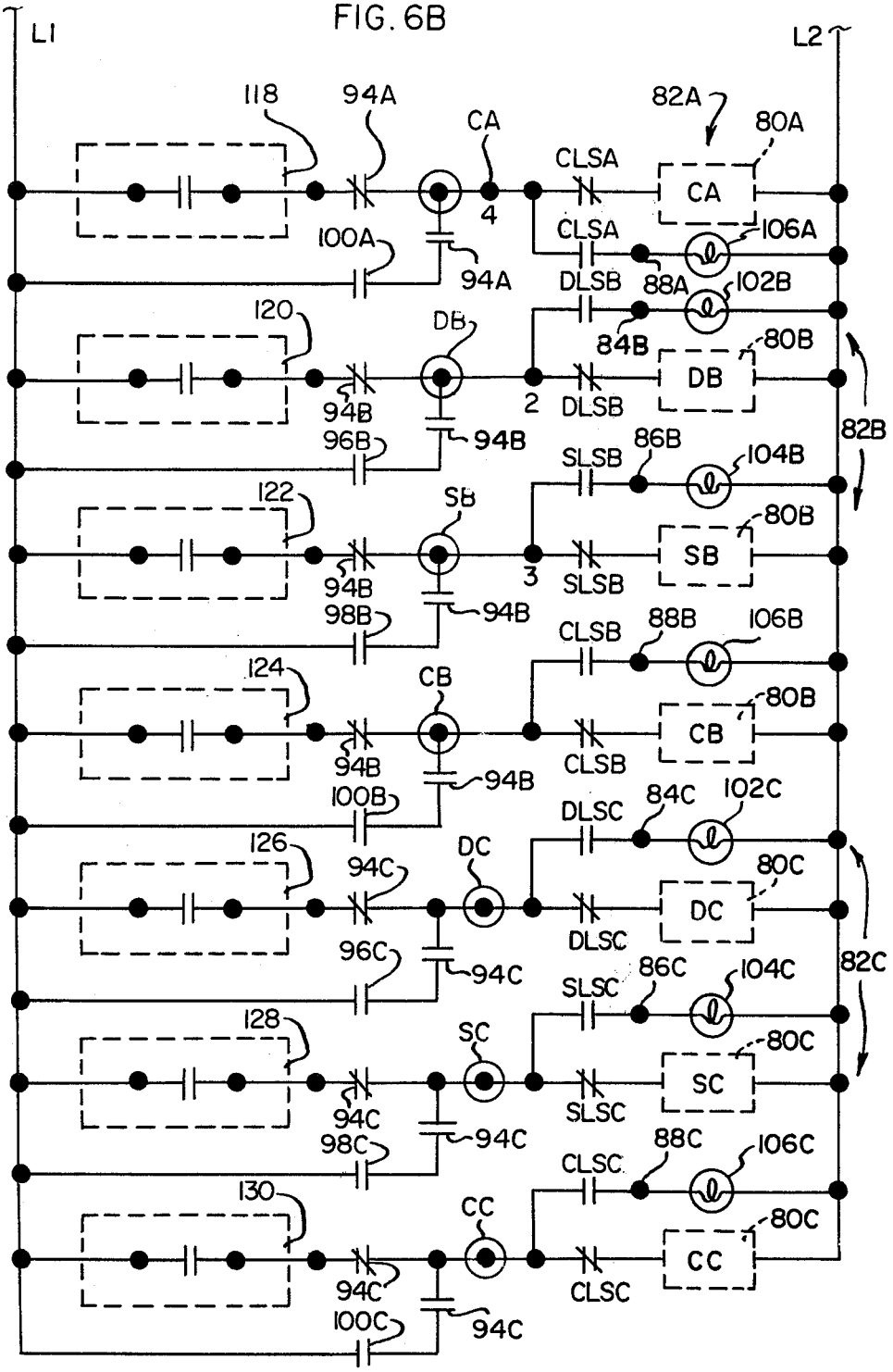

Referring now to FIGS. 6A and 6B, a circuit diagram of a portion of the control circuit of the novel control system is illustrated. Certain of the logic components of the circuit are shown in FIG. 7 which will be discussed hereinafter.

Referring initially to FIG. 6A, the master power on/off switch 90 and fuse 92 are fed from one side or "L-1" of a conventional 120-volt AC power source. The "L-2" or other side of this conventional power line is here designated as the ground side. A power supply for the logic circuits to be discussed below with reference to FIG. 7 is designated generally by the reference numeral 112 and in the illustrated embodiment comprises a regulated DC supply for converting the 120-volt AC line to a regulated 15 volts DC. The timer on/off switch 110 feeds an input interface to the logic circuit of FIG. 7 designated as input 1 (I-1) which also is tied to the ground side of the 120-volt AC power line. The high level sensors 27 associated with each of the three chambers 23, 24 and 25 are designated HLA, HLB, and HLC, respectively. Each of these sensors is symbolized as a normally open switch which feeds the 120V AC power to one side of a further input interface to the logic circuit of FIG. 7, designated respectively I-9, I-10 and I-11, each of which is also tied to circuit ground.

Figure 7:
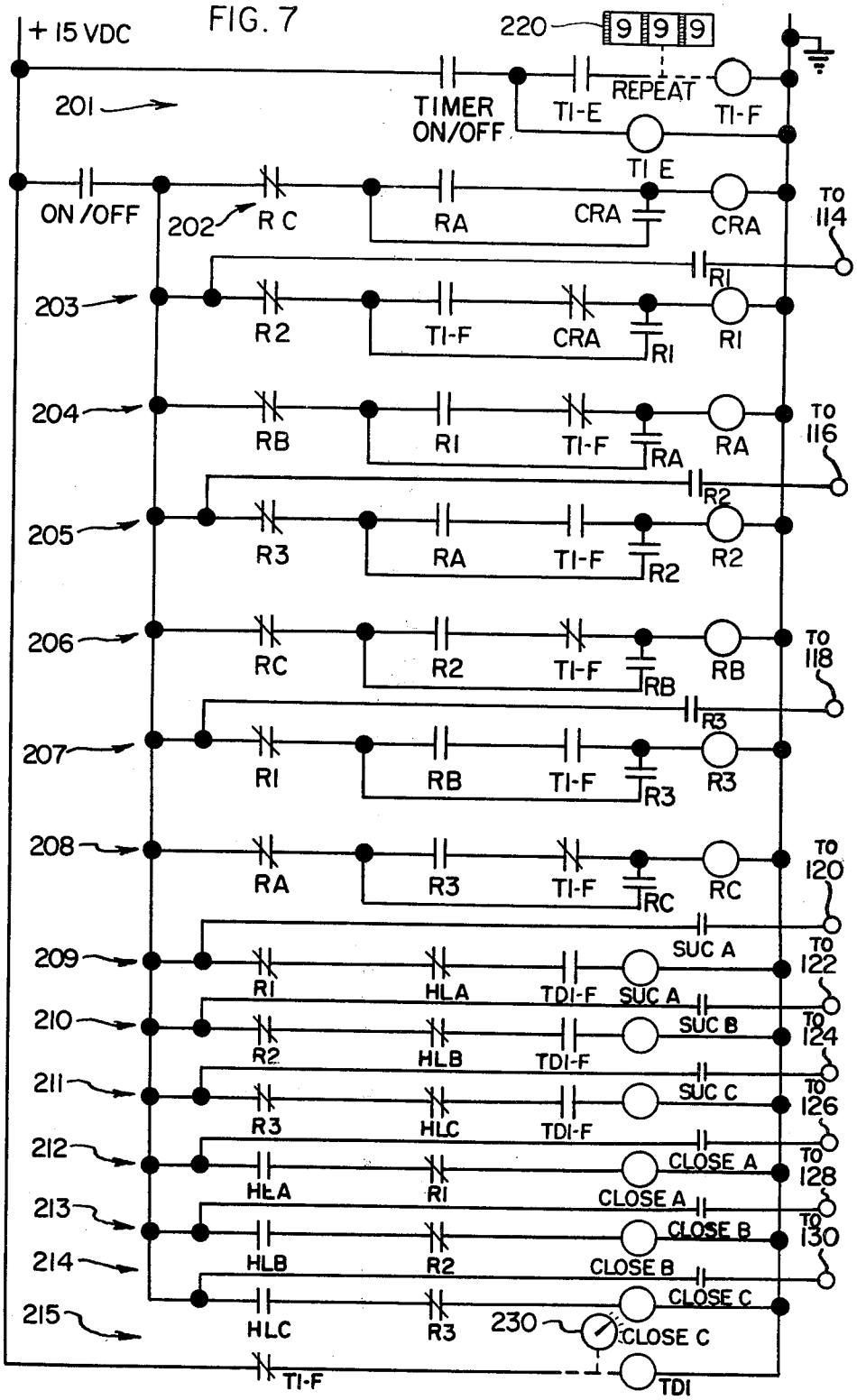
FIG. 7 is a circuit schematic diagram of another portion of the electronic control system of the invention.

An output interface 114 from the logic circuit of FIG. 7 feeds one side of a pair of normally closed contacts of the manual automatic switch 94A of FIG. 5. In parallel with this logic circuit output interface 114 is a pair of normally closed contacts of the discharge control switch 96A of the control panel of FIG. 5 in series with a pair of normally open contacts of the manual automatic switch 94A. The common output point of these parallel circuits feeds the input terminal DA of the valve actuator circuit 82A associated with the valve 65A for the chamber 23. This circuit point feeds the limit switches (LS) associated with the discharge position of the valve 65A, as mentioned above. These limit switches (LS) comprise a pair of normally open contacts feeding the lamp 102A by way of the output terminal 84A and a normally closed set of contacts which feed the suitable terminals of the motor 80A for turning the valve 65A in the proper direction to achieve connection of the pressure header 62 with the chamber 23.

A similar circuit in parallel across L-1 and L-2 comprises a logic circuit output interface 116 in series with a pair of normally closed contacts of the switch 94A. A parallel circuit comprises the suction control switch 98A and a pair of normally open contacts of the manual automatic switch 94A. The common output point of these parallel circuits feeds the suction control terminal SA of the valve actuator circuit 82A of FIG. 4. This circuit point feeds respective pairs of normally open and normally closed contacts of a similar limit switch (LS) which is actuated when the valve 65A is moved into position for delivering vacuum to the chamber 23. In the fashion described above, the normally closed contacts of this latter limit switch (LS) feed a control terminal of the motor 80A for achieving this motion of valve 65A while the normally opened contacts are connected for energizing the lamp 104A when this movement of the valve 65A has been achieved.

A third, similar circuit across the lines L-1, L-2 comprises a third logic circuit output interface 118 in series with a further pair of normally closed contacts of the manual/automatic switch 94A. A similar, parallel circuit comprises a pair of normally open contacts of the close control switch 100A and a pair of normally open contacts of the manual/automatic switch 94A. These two parallel circuits feed the control point C1A of the valve actuator circuit 82A. As with the previous two circuit portions this circuit point feeds the proper control terminal of the motor 80A by way of a normally closed set of contacts of the associated limit switch (LS) and also feeds the associated indicator lamp 106A by way of a pair of normally open contacts of the associated limit switch (LS).

The foregoing three circuit portions are repeated for the control of each of the remaining two valves 65 associated with the chambers 24 and 25 and are identical in each case, with the exception of the identity of the logic circuit output interfaces associated therewith, which are respectively indicated by reference numerals 120, 122, 124, 126, 128 and 130.

Referring now to FIG. 7, the logic circuits whose input and output interfaces are shown in FIGS. 6A and 6B are illustrated in detail. Initially, the circuit convention utilized in FIG. 7 comprises sets of normally closed and normally open relay contacts and associated relay coils. However, it will be understood that this logic circuit comprises a solid state logic circuit, preferably made up of components of the type generally designated LDC40 and available from Automatic Timing & Controls Co., King of Prussia, Pa., 19406. In this regard, the power supply 112 is also a component of the LDC40 family and is generally designated by the manufacturer's number 401A. Other manufacturer's numbered part designations will be given for various logic circuit components in the ensuing descriptions thereof.

Referring now to FIG. 7, the logic circuits are physically arranged in a plurality of generally parallel lines of components, each line comprising a given logic circuit component of the LDC40 logic family. In this regard, the top-most component 201 of FIG. 7 comprises a type 414 timer component of the LDC40 logic.

In accordance with the circuit convention utilized, the related "coil" component which addresses or "energizes" each "relay contact" component is indicated by the symbol designated immediately thereunder. Accordingly, a first set of normally open "relay contacts" of the first component 201 is accompanied by the designation timer on/off, indicating that this set of "contacts" is energized or addressed by the timer on/off switch 110 of FIG. 6A. In this regard, the input interface I-1 of FIG. 6A includes suitable circuitry for converting the 120 V AC power source to the 15 V DC level of the logic circuit of FIG. 7. The timer component illustrated in the first line includes a "coil" designated T1-F which is repeatedly energized at predetermined intervals by a second coil T1-E. This coil T1-E trips a normally open pair of relay contacts located in series with the coil T1-F. Suitable operator accessible controls 220 are provided for adjusting this predetermined timed interval, after which the coil T1-F is energized.

The remaining logic lines of FIG. 7 are all energized from the 15 V DC line by way of a normally open pair of contacts which is in turn energized, as indicated thereunder, in response to the master on/off switch 90.

The second logic component 202 includes a normally closed set of "contacts" energized by a "coil" RC (described later) in series with a normally open pair of "contacts" energized by a further "coil" RA to be described below. A "coil" CRA is in series with these two pairs of "contacts" and in turn energizes a further set of normally open "contacts" in parallel circuit with the "contacts" energized by the "coil" RA. This second logic component 202 is of the type designated 419A of the LDC40 components mentioned above, and is designated generally as a "self-interlocking relay". It will be seen that the self-interlocking nature thereof is provided by the set of normally open "contacts" energized by the "coil" CRA thereof.

In similar fashion, the next logic component 203 is also of the type designated 419A and includes a set of normally closed "contacts" energized by a "coil" F2 to be described later, a set of normally open "contacts" energized by the "coil" T1-F described above and further set of normally closed "contacts" energized by the "coil" CRA described above, all in series with a further "coil" R1. This "coil" R1 energizes an interlocking normally open set of "contacts" located in parallel circuit with the "contacts" energized by respective "coils" T1-F and CRA. In similar fashion, each of components 204, 205, 206, 207 and 208 comprises a type 419A logic component of the LDC40 type mentioned above, and includes sets of normally open and normally closed "contacts" and "coils" as designated in FIG. 7.

Components 209 through 214, inclusive, each comprises a type 410A logic component of the LDC40 family and includes sets of normally open or normally closed "contacts" and "coils" as indicated. It will be remembered that the designation immediately below each of the sets of "contacts" indicates the "coil" component responsible for the energization thereof.

The component 215 comprises a type 417A logic component of the LDC40 family and is designated a "time delay relay". In this regard, the relay "coil" TD1, as indicated by the circuit convention of a dashed line, is energized only after a predetermined time delay, when a normally closed set of "contacts" energized by "coil" T1-F is in its normally closed position. Energization of the "coil" T1-F causes this associated set of "contacts" of component 215 to revert to its normally open position, thereby de-energizing and resetting the time delay for subsequent energization of the "coil" TD1. This time delay is selectable by an operator control 230.

The output interfaces 114, 116, etc., through 130, inclusive, designated in FIGS. 6A and 6B, are fed from the terminals indicated by like reference numerals in the logic network of FIG. 7. It will be noted that these interfaces shown in block form in FIGS. 6A and 6B include suitable circuitry for converting to the 120 V AC level of the circuit of FIGS. 6A and 6B from the 15 V DC level of the circuit of FIG. 7. These interface circuit components are further described in a book entitled *LDC40 Line-O-Logic Controller,* published by Automatic Timing & Controls Co., King of Prussia, Pa., 19406. In the illustrated embodiment, the input and output interface components are as follows:

I-1, I-9, I-10 and I-11 are all of the type generally designated 431A of the LDC40 family of components. The interface circuit components 114, 116, etc., through 130, inclusive, are all of the type designated 450B.

Figure 8:
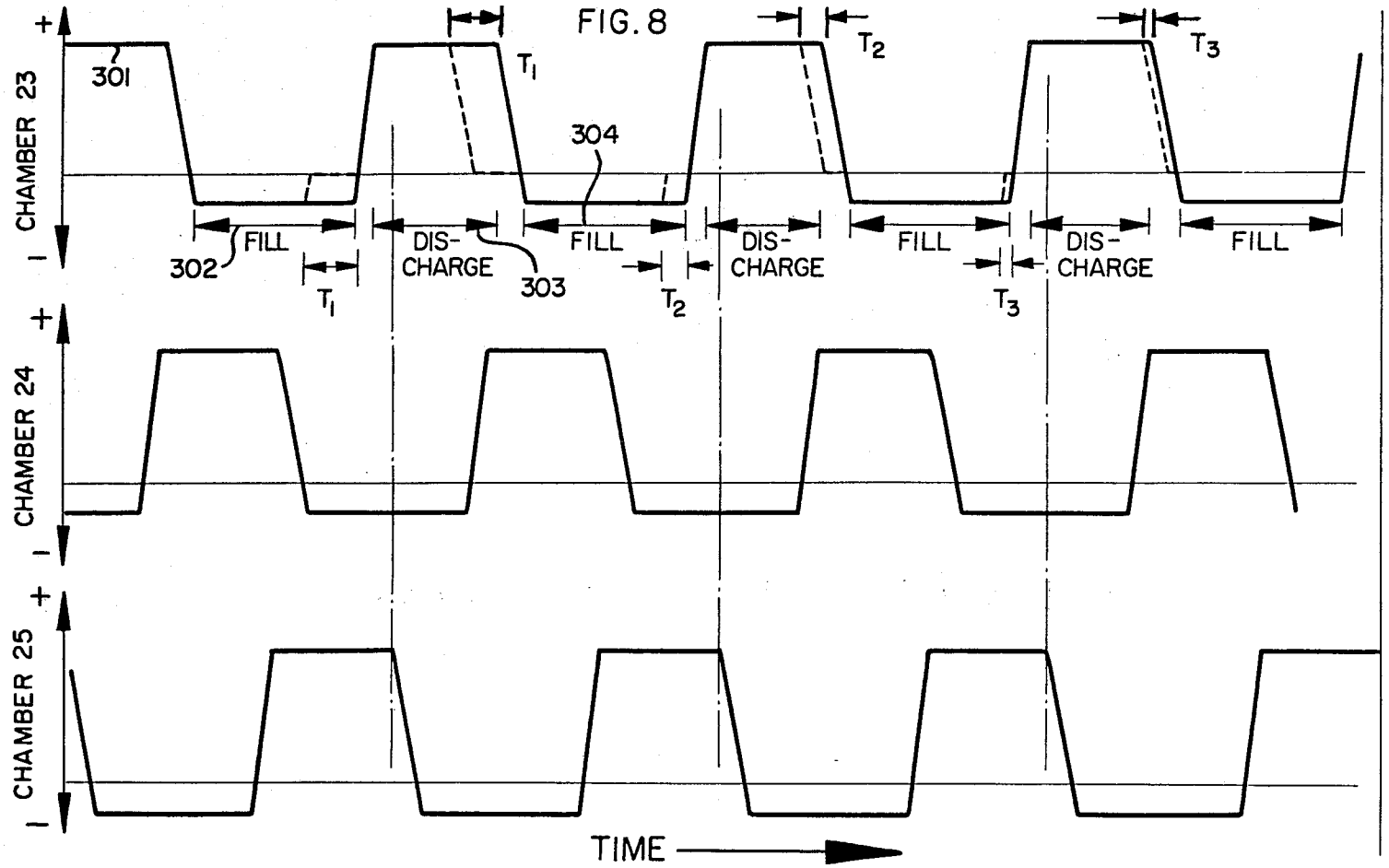
FIG. 8 is a chart showing pressures experienced within various pump chambers at various times and showing the staggered cyclic nature of pump operation.

In operation, the foregoing logic arrangement achieves an operating cycle generally as illustrated by the waveform diagram of FIG. 8, to which reference is next invited.

The operation of the pump 20 is represented in the chart of FIG. 8 in terms of the approximate pressure experienced within each of the chambers 23, 24 and 25 against a time axis. For example, during the time represented by the line segment 301, the chamber 23 is pressurized and is discharging dredge material. During the following time interval, represented by the line segment 302, the compressed air introduction has been halted and the vacuum port of the valve 65 has been opened so that the pressure in this same chamber 23 is reduced to a slightly negative value. During this time interval 302, therefore, the chamber 23 is being filled with dredge material. During the next succeeding time interval 303, the process is again reversed, so that the chamber 23 is subjected to pressurized air and is again discharging dredge material. It will be noted that the time intervals 301, 303, and the succeeding intervals labeled "discharge" are all substantially equal. Similarly, the time intervals 302 and succeeding intervals (e.g., 304) labeled "fill" are substantially equal.

The chambers 24 and 25 experience consecutive periods of pressurization and evacuation, of substantially the same lengths, respectively, as the intervals 302, 303, etc., as described for the chamber 23. However, it will be particularly noted that the operating cycles of each of these chambers 23, 24 and 25 is time-staggered with respect to each of the other chambers. Accordingly, the chart of FIG. 8 shows, for example, that as the first chamber 23 is discharging dredge material, the chamber 24 is filling with dredge material. At this same time, the third chamber 25 is discharging dredge material for a portion of this time 303 and filling with dredge material during another portion of this time 303.

This operation is controlled by the timing and arrangement of the logic elements set forth above with reference to FIG. 7. For example, as the terminal "to 114" becomes energized initiating discharge action of the chamber 23, the terminal "to 122" has been energized for a time to effect filling of the chamber 24. Similarly, the terminal "to 116" will likewise have been energized for a time to effect discharge of material from chamber 25, and shortly thereafter the terminal "to 124" will be energized for subsequent filling of the just-discharged chamber 25.

The "discharge" time intervals 301, 303, etc., are all substantially equal as are the "fill" time intervals 302, 304, etc. The respective "discharge" and "fill" time intervals are selectable by the operator by manipulation of the respective timing control dials 220 (for "discharge" time) and 230 (for "fill" time), illustrated and described above with reference to FIG. 7. In particular, the dial 220 sets the time in seconds for each of the time intervals 301, 303, etc., while the dial 230 is utilized to set, in seconds, the time for each of the intervals 302, 304, etc.

The high level sensor elements come into play only should one of the chambers 23, 24 or 25 be filled to its predetermined high level prior to the end of the preset time interval 302, for example. In this instance, the "close" control terminal "to 126", "to 128" or "to 130" as the case may be, is energized by the actuation of the associated high level sensor, while the corresponding vacuum or suction control terminal "to 120", "to 122" or "to 124" is de-energized by actuation of the high level sensor. Accordingly, the valve 65 will be returned to its closed position for the remainder of that portion of the cycle.

In similar fashion, in some applications it may be desirable to provide a low level sensor function analagous to that illustrated in FIG. 7 for the high level sensors. In this regard, a low level sensor input would be "addressed" to a normally open set of "contacts" in series with a normally closed set of "contacts" energized by the coils SUC-A, SUC-B and SUC-C, respectively. These two sets of "contacts" would then be placed in series with the CLOSE A, CLOSE B and CLOSE C "coils", respectively, to provide additional output signals to the same valve control terminals 126, 128 and 130. In other words, with reference to components 212, 213 and 214 of FIG. 7, merely replace the energizing "coil" designations "HLA, HLB, HLC", with "LLA, LLB, LLC" and the designations, "R1, R2, R3" with "SUC-A, SUC-B, SUC-C". Additionally, a further set of normally closed "contacts" would be interposed in series directly before respective outputs "to 114", "to 116" and "to 118" in FIG. 7.

These contacts would also be respectively energized by the respective low level sensors LLA, LLB and LLC, and function equivalently with the "contacts" energized by HLA, HLB and HLC in components 209, 210 and 211. In such an instance, a similar effect would occur in the discharge portion of the cycle (303, for example) during which the valve 65 would be returned to its closed state upon actuation of the associated low level sensor.

By observing the sequence of operation of the indicator lamps, 102, 104 and 106 for each of the valves and associated chambers, the operator can readily determine if the operation of the pump is reasonably efficient with the times which he has selected by operation of the timer controls 220 and 230. When these chambers are operating at optimum efficiency, the discharge lamp 102 and suction lamp 104 associated with each should remain lighted substantially throughout the respective discharge intervals, e.g., 301, 303, etc., and fill intervals, e.g., 302, 304, etc., interrupted by only a brief flashing of the closed lamp 106 therebetween.

However, should the closed lamps 106 remain lighted for a longer interval of time, for example, the interval T-1 indicated in dashed line in FIG. 8, the chamber is being either filled or discharged to the high and/or low level sensor levels before the expiration of the preset time interval. Accordingly, the operator may increase the appropriate time interval or intervals (by operating the timer control 220 and/or 230) until the closed lamp 106 becomes lighted for a shorter time, for example as indicated by T-2 in FIG. 8. Preferably, this operation of time adjustment and observation of the lighting of the indicator lamps 102, 104 and 106 may be repeated until the closure time is reduced to an acceptable minimum, e.g., T-3, which approaches zero, and is indicative of optimum pump efficiency. In this way, a relatively continuous flow of dredge material generated by the cutter 30 can be accommodated by the pump 20 and a relatively continuous, even flow of dredge material can be discharged from the pump 20. Additionally, a relatively continuous flow of compressed air to the pump can be accommodated and efficiently used.

The invention is claimed as follows:

1. A control system for a dredging device comprising a plurality of chambers, each chamber including an air port through which air can be delivered to and exhausted from the chamber, a material discharge port, a material suction port, and air port control means for alternately exhausting air from the chamber to admit material to the chamber through the suction port and delivering air to the chamber to discharge material from the chamber through the discharge port, said control system comprising: electrically energizable actuator means coupled with said air port control means and responsive to predetermined electrical control signals for causing actuation of said air port control means to a first position for said exhausting of air from the chamber, to a second position for said delivering of air to the chamber and to a third, intermediate position for effectively closing off the chamber to either air delivery or air exhaust, and electronic control means for providing said predetermined electrical control signals in a preselected cycle for cyclically operating all of said air port control means for admitting material to each chamber and discharging material from each chamber in said preselected cycle comprising the operation of the air port control means of each of said chambers in a time-staggered sequence with respect to that of each of the other chambers, whereby to provide a relatively uniform flow of material from the dredging device, said electronic control means further including controllable timer means for regulating said preselected cycle and operator adjustable control means for selectively varying said controllable timer means during operation of said dredging device so as to regulate said preselected cycle to achieve and maintain optimum efficiency of the dredging device.

2. A control system according to claim 1 and further including high level sensor means located in each said chamber for providing a high level signal when material admitted to the chamber reaches a predetermined high level and means responsive to said high level signal for overriding said controllable timer means and for actuating the air port control means for that chamber to its third position for closing said chamber during the remainder of the material discharge portion of the time sequence for that chamber.

3. A control system according to claim 1 or claim 2 and further including low level sensor means located in each said chamber for producing a low level control signal when material in the chamber reaches a predetermined low level and means responsive to said low level control signal for overriding said controllable timer means and for actuating said air port control means to its third position for closing the chamber during the remainder of the material admitting portion of the time sequence for that chamber.

4. A control system according to claim 1 or claim 2 wherein said controllable timer means includes a first timer for controlling the time during which each said air port control means is in said first position and a second timer for controlling the time during which each said air port control means is in said second position and wherein said operator adjustable control means includes means for independently selecting and varying as desired the time provided by each of said first and second timers.

5. A control system for a dredging device comprising three like chambers, each chamber including an air port through which air can be delivered to and exhausted from the chamber, a material discharge port, a material suction port and electrically energizable air port control means for alternately exhausting air from the chamber to admit material to the chamber through the suction port and delivering air to the chamber to discharge material from the chamber through the discharge port, said control system comprising: electrical energizing means coupled with said air port control means and responsive to predetermined electrical control signals for causing actuation of said air port control means to a first position for said exhausting of air from the chamber, to a second position for said delivering of air to the chamber and to a third, intermediate position for effectively closing off the chamber to either air delivery or air exhaust, and electronic control means coupled with said energizing means for producing said predetermined electrical control signals in a preselected cycle for cyclically operating said air port control means of each chamber for admitting material to the chamber and discharging material from the chamber in said preselected cycle said electronic control means being configured to provide said preselected cycle such that the operation of each chamber is time-staggered in a predetermined fashion with respect to the operation of each other chamber, said electronic control means further including controllable timer means for regulating said preselected cycle and operator adjustable control means for selectively varying said controllable timer means during operation of said dredging device so as to regulate said preselected cycle to achieve and maintain optimum efficiency of the dredging device.

6. A control system according to claim 5 and further including high level sensor means located in each chamber for providing a high level signal when material admitted to the chamber reaches a predetermined level and means responsive to said high level signal for overriding said controllable timer means and for actuating said air port control means of that chamber to its third position for closing that chamber during the remainder of the material discharge portion of the time sequence.

7. A control system according to claim 5 or claim 6 and further including low level sensor means located in each chamber for producing a low level signal when material in the chamber reaches a second predetermined level and means responsive to said low level signal for overriding said controllable timer means and for actuating said air port control means of that chamber to its third position for closing that chamber during the remainder of the material admitting portion of said time sequence.

8. A control system according to claim 7 wherein said controllable timer means includes first timing means for controlling the time during which each of said air port control means is in said first position and second timing means for controlling the time during which each said air port control means is in the second position and wherein said operator adjustable control means includes means for independently selecting and varying as desired the time provided by each of said first and second timer means.

9. A control system according to claim 5 wherein said controllable timer means includes first timing means for controlling the discharge portion of said time sequence and second timing means for controlling the suction portion of said time sequence, and wherein said operator accessible means includes separate selection means for selecting the preselected time provided by each of said first and second timing means.

10. A control system according to claim 1 or claim 5 and further including operator selectable manual/automatic control means for selectively disabling the response of each of said air port control means to said electronic control means and operator selectable electrical control means for operating said air port control means of each chamber when so disabled separately in response to operator manipulation of said operator selectable electrical control means.

* * * * *